US007997885B2

(12) United States Patent
Allum

(10) Patent No.: US 7,997,885 B2
(45) Date of Patent: Aug. 16, 2011

(54) ROOTS-TYPE BLOWER REDUCED ACOUSTIC SIGNATURE METHOD AND APPARATUS

(75) Inventor: Todd W. Allum, Redlands, CA (US)

(73) Assignee: CareFusion 303, Inc., San Diego, CA (US)

( * ) Notice: Subject to any disclaimer, the term of this patent is extended or adjusted under 35 U.S.C. 154(b) by 694 days.

(21) Appl. No.: 12/050,541

(22) Filed: Mar. 18, 2008

(65) Prior Publication Data

US 2009/0142213 A1 Jun. 4, 2009

Related U.S. Application Data

(60) Provisional application No. 60/991,977, filed on Dec. 3, 2007.

(51) Int. Cl.
*F01C 21/00* (2006.01)
*F03C 2/00* (2006.01)
*F03C 4/00* (2006.01)

(52) U.S. Cl. ..... 418/189; 418/206.1; 418/206.4

(58) Field of Classification Search ..... 418/206.1, 418/206.4, 189, 190

See application file for complete search history.

(56) References Cited

U.S. PATENT DOCUMENTS

| | | | | |
|---|---|---|---|---|
| 56,614 | A | | 7/1866 | Roots et al. |
| 587,907 | A | | 8/1897 | Ames et al. |
| 1,769,153 | A | | 7/1930 | Meyer |
| 2,014,932 | A | | 9/1935 | Hallett |
| 2,787,999 | A | | 4/1957 | Bennett ..... 128/30 |
| 3,089,638 | A | | 5/1963 | Rose ..... 230/141 |
| 3,094,274 | A | | 6/1963 | Thompson ..... 230/224 |
| 3,286,643 | A | * | 11/1966 | Andrews et al. ..... 418/206.1 |
| 3,371,856 | A | | 3/1968 | Thelen et al. ..... 230/141 |
| 3,459,395 | A | | 8/1969 | Scotto ..... 248/20 |
| 3,658,443 | A | | 4/1972 | Fumagalli ..... 417/384 |
| 3,941,206 | A | | 3/1976 | Halter ..... 181/50 |
| 4,080,103 | A | | 3/1978 | Bird ..... 417/3 |
| 4,121,578 | A | | 10/1978 | Torzala ..... 128/142 R |
| 4,215,977 | A | | 8/1980 | Weatherston ..... 418/1 |
| 4,220,219 | A | | 9/1980 | Flugger ..... 181/265 |
| 4,227,869 | A | | 10/1980 | Eriksson ..... 418/206 |
| 4,239,039 | A | | 12/1980 | Thompson ..... 128/205.24 |
| 4,267,899 | A | | 5/1981 | Wagner et al. ..... 181/272 |
| 4,323,064 | A | | 4/1982 | Hoenig et al. ..... 128/204.21 |
| 4,448,192 | A | | 5/1984 | Stawitcke et al. ..... 128/204.26 |
| 4,455,132 | A | | 6/1984 | Messori ..... 418/206 |
| 4,495,947 | A | | 1/1985 | Motycka ..... 128/205.14 |
| 4,556,373 | A | * | 12/1985 | Soeters, Jr. ..... 418/189 |
| 4,564,345 | A | | 1/1986 | Mueller ..... 418/206 |
| 4,595,349 | A | | 6/1986 | Preston et al. ..... 418/206 |

(Continued)

FOREIGN PATENT DOCUMENTS

DE 3238015 4/1984

(Continued)

OTHER PUBLICATIONS

M.L. Munjal, "Acoustics of Ducts and Mufflers," John Wiley & Sons, 1987, chapter 8.

(Continued)

*Primary Examiner* — Theresa Trieu

(57) ABSTRACT

A Roots-type blower with helical cycloidal rotors features relief recesses in the chamber walls, isolated from the input and output ports. The relief recesses counter variation in leakback flow with angular position intrinsic to helical cycloidal rotors, attenuating a noise source.

12 Claims, 7 Drawing Sheets

U.S. PATENT DOCUMENTS

| | | | | |
|---|---|---|---|---|
| 4,609,335 | A | 9/1986 | Uthoff, Jr. | 418/201 |
| 4,666,384 | A | 5/1987 | Kaga et al. | 418/150 |
| 4,673,058 | A | 6/1987 | Roberts et al. | 181/266 |
| 4,684,330 | A | 8/1987 | Andersson et al. | 417/360 |
| 4,686,999 | A | 8/1987 | Snyder et al. | 128/716 |
| 4,702,240 | A | 10/1987 | Choui | 128/204.18 |
| 4,768,934 | A | 9/1988 | Soeters, Jr. | 418/1 |
| 4,781,541 | A | 11/1988 | Sohler et al. | 417/312 |
| 4,794,922 | A | 1/1989 | DeVries | 128/204.18 |
| 4,844,044 | A | 7/1989 | McGovern | 123/559.1 |
| 4,846,302 | A | 7/1989 | Hetherington | 181/243 |
| 4,867,151 | A | 9/1989 | Bird | 128/201.17 |
| 4,938,670 | A | 7/1990 | Lee | 418/150 |
| 4,957,107 | A | 9/1990 | Sipin | 128/204.21 |
| 4,975,032 | A | 12/1990 | Arai et al. | 418/150 |
| 5,040,959 | A | 8/1991 | Fukagawa | 418/150 |
| 5,056,995 | A | 10/1991 | Tamura et al. | 418/201.1 |
| 5,131,829 | A | 7/1992 | Hampton | 418/189 |
| 5,145,349 | A | 9/1992 | McBurnett | 418/206 |
| 5,152,684 | A | 10/1992 | Steffens | 418/150 |
| 5,161,525 | A | 11/1992 | Kimm et al. | 128/204.26 |
| 5,211,170 | A | 5/1993 | Press | 128/204.18 |
| 5,222,148 | A | 6/1993 | Yuan | 381/71 |
| 5,237,987 | A | 8/1993 | Anderson et al. | 128/204.18 |
| 5,239,994 | A | 8/1993 | Atkins | 128/204.18 |
| 5,335,651 | A | 8/1994 | Foster et al. | 128/202.13 |
| 5,350,888 | A | 9/1994 | Sager, Jr. et al. | 181/247 |
| 5,398,676 | A | 3/1995 | Press et al. | 128/204.23 |
| 5,439,358 | A | 8/1995 | Weinbrecht | 418/15 |
| 5,452,714 | A | 9/1995 | Anderson et al. | 128/205.11 |
| 5,542,416 | A | 8/1996 | Chalvignac | 128/204.23 |
| 5,577,152 | A | 11/1996 | Chen | 388/804 |
| 5,582,163 | A | 12/1996 | Bonassa | 128/204.26 |
| 5,632,270 | A | 5/1997 | O'Mahony et al. | 128/204.24 |
| 5,638,600 | A | 6/1997 | Rao et al. | 29/888.02 |
| 5,664,563 | A | 9/1997 | Schroeder et al. | 128/204.25 |
| 5,687,717 | A | 11/1997 | Halpern et al. | 128/630 |
| 5,694,926 | A | 12/1997 | DeVries et al. | 128/205.24 |
| 5,701,883 | A | 12/1997 | Hete et al. | 128/204.26 |
| 5,702,240 | A | 12/1997 | O'Neal et al. | 418/9 |
| 5,760,348 | A | 6/1998 | Heuser | 181/272 |
| 5,763,792 | A | 6/1998 | Kullik | 73/861.53 |
| 5,783,782 | A | 7/1998 | Sterrett et al. | 181/272 |
| 5,823,186 | A | 10/1998 | Rossen et al. | 128/204.21 |
| 5,831,223 | A | 11/1998 | Kesselring | 181/227 |
| 5,868,133 | A | 2/1999 | DeVries et al. | 128/204.21 |
| 5,881,722 | A | 3/1999 | DeVries et al. | 128/204.21 |
| 5,918,597 | A | 7/1999 | Jones et al. | 128/205.18 |
| 5,931,159 | A | 8/1999 | Suzuki et al. | 128/204.18 |
| 5,944,501 | A | 8/1999 | Yokoi | 418/181 |
| 6,009,871 | A | 1/2000 | Kiske et al. | 128/204.21 |
| 6,076,523 | A | 6/2000 | Jones et al. | 128/205.11 |
| 6,099,277 | A | 8/2000 | Patel et al. | 418/1 |
| 6,102,038 | A | 8/2000 | DeVries | 128/205.24 |
| 6,125,844 | A | 10/2000 | Samiotes | 128/200.23 |
| 6,152,129 | A | 11/2000 | Berthon-Jones | 128/200.24 |
| 6,152,135 | A | 11/2000 | DeVries et al. | 128/205.24 |
| 6,155,257 | A | 12/2000 | Lurie et al. | 128/204.23 |
| 6,158,430 | A | 12/2000 | Pfeiffer et al. | 128/202.27 |
| 6,158,434 | A | 12/2000 | Lugtigheid et al. | 128/204.22 |
| 6,164,412 | A | 12/2000 | Allman | 181/272 |
| 6,176,693 | B1 | 1/2001 | Conti | 418/180 |
| 6,279,574 | B1 | 8/2001 | Richardson et al. | 128/204.18 |
| 6,283,246 | B1 | 9/2001 | Nishikawa | 181/255 |
| 6,305,372 | B1 | 10/2001 | Servidio | 128/204.21 |
| 6,354,558 | B1 | 3/2002 | Li | 248/615 |
| 6,412,483 | B1 | 7/2002 | Jones et al. | 128/205.11 |
| 6,474,960 | B1 | 11/2002 | Hansmann | 417/363 |
| 6,484,719 | B1 | 11/2002 | Berthon-Jones | 128/204.23 |
| 6,526,970 | B2 | 3/2003 | DeVries et al. | 128/204.21 |
| 6,543,449 | B1 | 4/2003 | Woodring et al. | 128/204.18 |
| 6,558,137 | B2 | 5/2003 | Tomell et al. | 417/312 |
| 6,564,798 | B1 | 5/2003 | Jalde | 128/205.24 |
| 6,571,792 | B1 | 6/2003 | Hendrickson et al. | 128/203.12 |
| 6,571,796 | B2 | 6/2003 | Banner et al. | 128/204.26 |
| 6,591,835 | B1 | 7/2003 | Blanch | 128/204.25 |
| 6,615,831 | B1 | 9/2003 | Tuitt et al. | 128/204.18 |
| 6,619,286 | B2 | 9/2003 | Patel | 128/204.26 |
| 6,626,175 | B2 | 9/2003 | Jafari et al. | 128/204.21 |
| 6,629,525 | B2 | 10/2003 | Hill et al. | 128/202.26 |
| 6,629,531 | B2 | 10/2003 | Gleason et al. | 128/205.25 |
| 6,629,934 | B2 | 10/2003 | Mault et al. | 600/538 |
| 6,631,716 | B1 | 10/2003 | Robinson et al. | 128/204.21 |
| 6,637,430 | B1 | 10/2003 | Voges et al. | 128/200.14 |
| 6,651,658 | B1 | 11/2003 | Hill et al. | 128/204.23 |
| 6,666,209 | B2 | 12/2003 | Bennett et al. | 128/200.24 |
| 6,672,300 | B1 | 1/2004 | Grant | 124/204.26 |
| 6,691,702 | B2 | 2/2004 | Appel et al. | 128/202.26 |
| 6,691,707 | B1 | 2/2004 | Gunaratnam et al. | 128/206.21 |
| 6,708,690 | B1 | 3/2004 | Hete et al. | 128/204.18 |
| 6,745,770 | B2 | 6/2004 | McAuliffe et al. | 128/205.24 |
| 6,752,240 | B1 | 6/2004 | Schlagenhaft | 181/249 |
| 6,764,534 | B2 | 7/2004 | McCombs et al. | 96/111 |
| 6,770,037 | B2 | 8/2004 | Sullivan et al. | 600/529 |
| 6,782,888 | B1 | 8/2004 | Friberg et al. | 128/204.18 |
| 6,802,225 | B2 | 10/2004 | Shahar et al. | 73/861.52 |
| 6,820,618 | B2 | 11/2004 | Banner et al. | 128/204.23 |
| 6,837,260 | B1 | 1/2005 | Kuehn | 137/315.01 |
| 6,877,511 | B2 | 4/2005 | DeVries et al. | 128/204.26 |
| 6,968,842 | B1 | 11/2005 | Truschel et al. | 128/204.18 |
| 7,004,908 | B2 | 2/2006 | Sullivan et al. | 600/529 |
| 7,011,092 | B2 | 3/2006 | McCombs et al. | 128/205.12 |
| 7,032,589 | B2 | 4/2006 | Kerechanin et al. | 128/200.24 |
| 7,063,084 | B2 | 6/2006 | McDonald | 128/200.28 |
| 7,066,178 | B2 | 6/2006 | Gunaratnam et al. | 128/206.21 |
| 7,066,985 | B2 | 6/2006 | Deane et al. | 95/96 |
| 7,073,499 | B1 | 7/2006 | Reinhold et al. | 128/200.18 |
| 7,086,366 | B1 | 8/2006 | Killion | 123/192.2 |
| 7,118,536 | B2 | 10/2006 | Haberland et al. | 600/538 |
| 7,121,276 | B2 | 10/2006 | Jagger et al. | 128/201.21 |
| 7,168,429 | B2 | 1/2007 | Matthews et al. | 128/204.21 |
| 7,171,963 | B2 | 2/2007 | Jagger et al. | 128/201.21 |
| 7,183,681 | B2 | 2/2007 | Segawa et al. | 310/68 B |
| 7,188,621 | B2 | 3/2007 | DeVries et al. | 128/204.21 |
| 7,225,809 | B1 | 6/2007 | Bowen et al. | 128/204.21 |
| 7,226,280 | B1 | 6/2007 | Yokoi et al. | 418/206.4 |
| 7,329,304 | B2 | 2/2008 | Bliss et al. | 95/12 |
| 7,331,342 | B2 | 2/2008 | Spearman et al. | 128/203.14 |
| 7,335,243 | B2 | 2/2008 | Homan et al. | 55/385.2 |
| 7,351,034 | B2 | 4/2008 | Cens et al. | 416/61 |
| 7,368,005 | B2 | 5/2008 | Bliss et al. | 96/121 |
| 2001/0044588 | A1 | 11/2001 | Mault | 600/549 |
| 2002/0134378 | A1 | 9/2002 | Finnegan et al. | 128/200.24 |
| 2003/0057904 | A1 | 3/2003 | Sacher | 318/268 |
| 2003/0208113 | A1 | 11/2003 | Mault et al. | 600/316 |
| 2004/0074495 | A1 | 4/2004 | Wickham et al. | 128/204.18 |
| 2004/0147818 | A1 | 7/2004 | Levy et al. | 600/300 |
| 2004/0211422 | A1 | 10/2004 | Arcilla et al. | 128/204.19 |
| 2004/0221854 | A1 | 11/2004 | Hete et al. | 128/207.16 |
| 2004/0226562 | A1 | 11/2004 | Bordewick | 128/204.23 |
| 2005/0112013 | A1 | 5/2005 | DeVries et al. | 418/206.1 |
| 2005/0124866 | A1 | 6/2005 | Elaz et al. | 600/301 |
| 2005/0166921 | A1 | 8/2005 | DeVries et al. | 128/204.21 |
| 2005/0188991 | A1 | 9/2005 | Sun et al. | 128/204.23 |
| 2005/0241642 | A1 | 11/2005 | Krzysztofik | 128/206.15 |
| 2006/0065672 | A1 | 3/2006 | Lecourt et al. | 222/3 |
| 2006/0069326 | A1 | 3/2006 | Heath | 601/41 |
| 2006/0070624 | A1 | 4/2006 | Kane et al. | 128/204.23 |
| 2006/0124128 | A1 | 6/2006 | Deane et al. | 128/204.21 |
| 2006/0144396 | A1 | 7/2006 | DeVries et al. | 128/204.21 |
| 2006/0144399 | A1 | 7/2006 | Davidowski et al. | 128/205.21 |
| 2006/0144405 | A1 | 7/2006 | Gunaratnam et al. | 128/206.21 |
| 2006/0150973 | A1 | 7/2006 | Chalvignac | 128/214.21 |
| 2006/0174871 | A1 | 8/2006 | Jagger et al. | 128/201.21 |
| 2006/0174872 | A1 | 8/2006 | Jagger et al. | 128/201.21 |
| 2006/0174874 | A1 | 8/2006 | Jagger et al. | 128/201.21 |
| 2006/0174875 | A1 | 8/2006 | Jagger et al. | 128/201.21 |
| 2006/0174877 | A1 | 8/2006 | Jagger et al. | 128/201.21 |
| 2006/0174878 | A1 | 8/2006 | Jagger et al. | 128/201.21 |
| 2006/0174880 | A1 | 8/2006 | Jagger et al. | 128/201.25 |
| 2006/0174881 | A1 | 8/2006 | Jagger et al. | 128/201.25 |
| 2006/0174882 | A1 | 8/2006 | Jagger et al. | 128/201.25 |
| 2006/0201503 | A1 | 9/2006 | Breen | 128/204.18 |
| 2006/0213518 | A1 | 9/2006 | DeVries et al. | 128/204.21 |
| 2006/0249149 | A1 | 11/2006 | Meier et al. | 128/204.18 |
| 2006/0266355 | A1 | 11/2006 | Misholi | 128/204.23 |
| 2006/0283450 | A1 | 12/2006 | Shissler et al. | 128/204.21 |

| | | | | |
|---|---|---|---|---|
| 2007/0044799 | A1 | 3/2007 | Hete et al. | 128/205.11 |
| 2007/0062529 | A1 | 3/2007 | Choncholas et al. | 128/204.22 |
| 2007/0062532 | A1 | 3/2007 | Choncholas | 128/204.23 |
| 2007/0068526 | A1 | 3/2007 | Lang et al. | 128/204.22 |
| 2007/0079826 | A1 | 4/2007 | Kramer et al. | 128/200.14 |
| 2007/0113843 | A1 | 5/2007 | Hughes | 128/200.24 |
| 2007/0113849 | A1 | 5/2007 | Matthews et al. | 128/204.22 |
| 2007/0169776 | A1 | 7/2007 | Kepler et al. | 128/200.23 |
| 2007/0181127 | A1 | 8/2007 | Jin et al. | 128/204.21 |
| 2007/0193580 | A1 | 8/2007 | Feldhahn et al. | 128/204.18 |
| 2007/0215146 | A1 | 9/2007 | Douglas et al. | 128/200.24 |
| 2007/0221224 | A1 | 9/2007 | Pittman et al. | 128/204.22 |
| 2007/0235030 | A1 | 10/2007 | Teetzel et al. | 128/205.12 |
| 2007/0265877 | A1 | 11/2007 | Rice et al. | 705/2 |
| 2007/0277825 | A1 | 12/2007 | Bordewick et al. | 128/204.23 |
| 2008/0000474 | A1 | 1/2008 | Jochle et al. | 128/204.18 |
| 2008/0029096 | A1 | 2/2008 | Kollmeyer et al. | 128/204.21 |
| 2008/0035149 | A1 | 2/2008 | Sutton | 128/205.24 |
| 2008/0039701 | A1 | 2/2008 | Ali et al. | 600/301 |
| 2008/0066739 | A1 | 3/2008 | LeMahieu et al. | 128/200.14 |
| 2008/0078395 | A1 | 4/2008 | Ho et al. | 128/205.24 |
| 2008/0099017 | A1 | 5/2008 | Bordewick et al. | 128/204.21 |
| 2008/0110455 | A1 | 5/2008 | Dunsmore et al. | 128/200.24 |
| 2008/0110458 | A1 | 5/2008 | Srinivasan et al. | 128/203.26 |
| 2008/0110462 | A1 | 5/2008 | Chekal et al. | 128/204.26 |
| 2008/0127976 | A1 | 6/2008 | Acker et al. | 128/204.18 |

FOREIGN PATENT DOCUMENTS

| | | | | | |
|---|---|---|---|---|---|
| DE | 3414064 | | | 10/1985 | |
| DE | 3620792 | | | 12/1987 | |
| DE | 19817356 | | | 10/1999 | |
| EP | 0239026 | | | 9/1987 | |
| EP | 0521709 | | | 1/1993 | |
| EP | 0938909 | | | 9/1999 | |
| EP | 1130761 | | | 9/2001 | |
| EP | 1243282 | | | 9/2002 | |
| FR | 2875891 | | | 9/2004 | |
| GB | 2157370 | | | 10/1985 | |
| JP | 61123793 | A | * | 6/1986 | 418/180 |
| JP | 2001 050774 | | | 2/2001 | |
| JP | 2003 124986 | | | 4/2003 | |
| WO | WO 89/10768 | | | 11/1989 | |
| WO | WO 92/11054 | | | 7/1992 | |
| WO | WO 96/11717 | | | 4/1996 | |
| WO | WO 97/11522 | | | 3/1997 | |
| WO | WO 97/15343 | | | 5/1997 | |
| WO | WO 99/64825 | | | 12/1999 | |
| WO | WO 00/45883 | | | 8/2000 | |
| WO | WO 02/11861 | | | 2/2002 | |
| WO | WO 2004/040745 | | | 5/2004 | |

OTHER PUBLICATIONS

Eaton, "Why an Eaton Supercharger?" www.eaton.com/supercharger/whysuper.html.

* cited by examiner

ROOTS-TYPE BLOWER REDUCED ACOUSTIC SIGNATURE METHOD AND APPARATUS

CLAIM OF PRIORITY

This application claims priority to Provisional U.S. Patent Application entitled ROOTS-TYPE BLOWER REDUCED ACOUSTIC SIGNATURE METHOD AND APPARATUS, filed Dec. 3, 2007, having application No. 60/991,977, the disclosure of which is hereby incorporated by reference in its entirety.

FIELD OF THE INVENTION

The present invention relates generally to Roots-type blowers. More specifically, the invention relates to reduction of intrinsic helical-rotor pulse noise in Roots-type blowers.

BACKGROUND OF THE INVENTION

A characteristic Roots-type blower has two parallel, equal-sized, counter-rotating, lobed rotors in a housing. The housing interior typically has two parallel, overlapping, equal-sized cylindrical chambers in which the rotors spin. Each rotor has lobes that interleave with the lobes of the other, and is borne on a shaft carried on bearings, although both the shaft and the bearing arrangement may be integral at least in part to the rotor and/or the housing. In modern practice, rotor lobes of Roots-type blowers have screw, involute, or cycloidal profiles (those shown in the figures of this application are cycloidal), typically approximated as a series of arcs, and are driven by 1:1-ratio gears housed within a compartment separate from the rotor chamber. One of the rotor shafts is generally driven by an external power source, such as an electric motor, while the other is driven from the first. An inlet port and an outlet port are formed by removal of some portion of the material along the region of overlap between the cylindrical chamber bores. Net flow is transverse to the plane of the rotor shafts: the pumped material moves around the perimeter of the rotors from inlet to outlet, drawn into the blower as the interleaved lobes move from the center of the cavity toward the inlet port, opening a void; carried around the chamber in alternate "gulps" of volume between two lobes of a rotor in a cylinder, released to the outlet port by the lifting of the leading lobe of each successive gulp from the cylinder wall, then forced out the outlet port as each lobe enters the next interlobe trough of the opposite rotor near the outlet port.

The number of lobes per rotor may be any; for example, two-, three-, and four-lobed rotors are known. So-called gear pumps are variations on Roots-type blowers that use involute lobe shape to allow the lobes to function as gears with rolling interfacial contact; such designs also allow an option of differential numbers of teeth.

Before the early 1900s, lobes of Roots-type blowers were straight (lines defining the surfaces were parallel to the respective axes of rotation) rather than helical. Blowers with such lobes produce significant fluctuations in output during each rotation, as the incremental displaced volume is non-constant. Leakback (flow from the outlet side back to the inlet side) between properly-shaped straight lobes can be substantially constant, however, to the extent that all gaps can be made uniform and invariant. Developments in manufacturing technology by the 1930s included the ability, at reasonable cost, to make gear teeth and compressor lobes that advance along the axes of rotation following a helical path. This led to Roots-type blowers with effectively constant displaced volume rather than discrete pulses, such as those disclosed by Hallet, U.S. Pat. No. 2,014,932. Such blowers have displayed pulsating leakback, however, so that the net delivered flow remains non-constant.

SUMMARY OF THE INVENTION

Some embodiments of the present invention reduce pulse energy and associated noise in a Roots-type blower by rendering leakback appreciably more uniform with respect to rotor angular position than in previous helical-rotor designs. The principal mechanism for this uniformity is a relief recess positioned to balance a specific source of variation in leakback as a function of angular position during rotation.

A Roots-type blower according to one aspect has a housing enclosing two gear-synchronized rotors. The rotors are substantially identical, except that the rotors have helical lobes that advance along the length of the rotors as long-pitch screws of opposite handedness. The rotors ride on shafts to which the synchronizing gears are attached to cause the rotors counter-rotate so that the lobes interleave with non-interfering clearance sufficiently close to support blower function. One shaft extends for attachment to a motor.

The housing further includes twinned cylindrical bores that also include inlet and outlet ports. The outlet port includes relief grooves that couple air from the outlet port partway back along each rotor. There are additional recesses in the cylinder region generally opposite the area of interleaving between the rotors. The dimensions and locations of the relief grooves and recesses, along with the shape and orientation of each port, serve to reduce noise compared to otherwise similar blowers without diminishing blower functionality for at least some purposes.

In one aspect, a Roots-type blower exhibiting reduced noise is presented. The blower includes a pair of rotors, configured to counter-rotate about parallel axes in an axis plane, wherein the respective rotors each comprise a plurality of cycloidal-profile lobes advancing with axial position as opposite-handed helices, and wherein rotation of maximum radial extents (tips) of the respective rotor lobes defines a negative body in the form of a pair of overlapping cylindrical sections truncated at axial extents of the rotors, and a blower housing with walls that define a chamber to enclose the rotor pair, wherein the negative body establishes a physical extent of the chamber, and wherein the chamber wall is further positioned away from the negative body by a substantially uniform clearance distance.

The blower further includes an inlet port penetrating the chamber wall, wherein an inlet port perimeter wall is symmetric about an interface plane substantially equidistant between the rotor axes, an outlet port penetrating the chamber wall, wherein an outlet port perimeter wall is symmetric about the interface plane at a location substantially opposed to that of the inlet port, and a pair of relief recesses in the chamber wall, positioned and shaped with substantial bilateral symmetry to one another with reference to the interface plane, wherein the relief recesses are bounded on their respective perimeters by continuous cylindrically curved portions of the chamber wall.

In another aspect, a Roots-type blower exhibiting reduced noise is presented. The blower includes a twinned cylindrical chamber fitted with a pair of shaft-borne rotors, equipped with cycloidal-profile, helical rotor lobes meshing closely and geared together so that a motor applying power to one impels fluid flow from an inlet port to an outlet port of the blower with an increase in average pressure, and pair of compensating relief recesses positioned within the chamber, isolated from the inlet and outlet ports, having dimensions compatible with providing an augmenting, periodically-varying rate of leakback flow from the outlet port to the inlet port that compensates for a characteristic variation in leakback flow due to rotor configuration.

In yet another aspect, a method for reducing noise in a Roots-type blower is presented. The method includes introducing a secondary leakback path between rotors and walls of a Roots-type blower sufficient to offset variation of leakback with angular position characteristic of the rotors.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
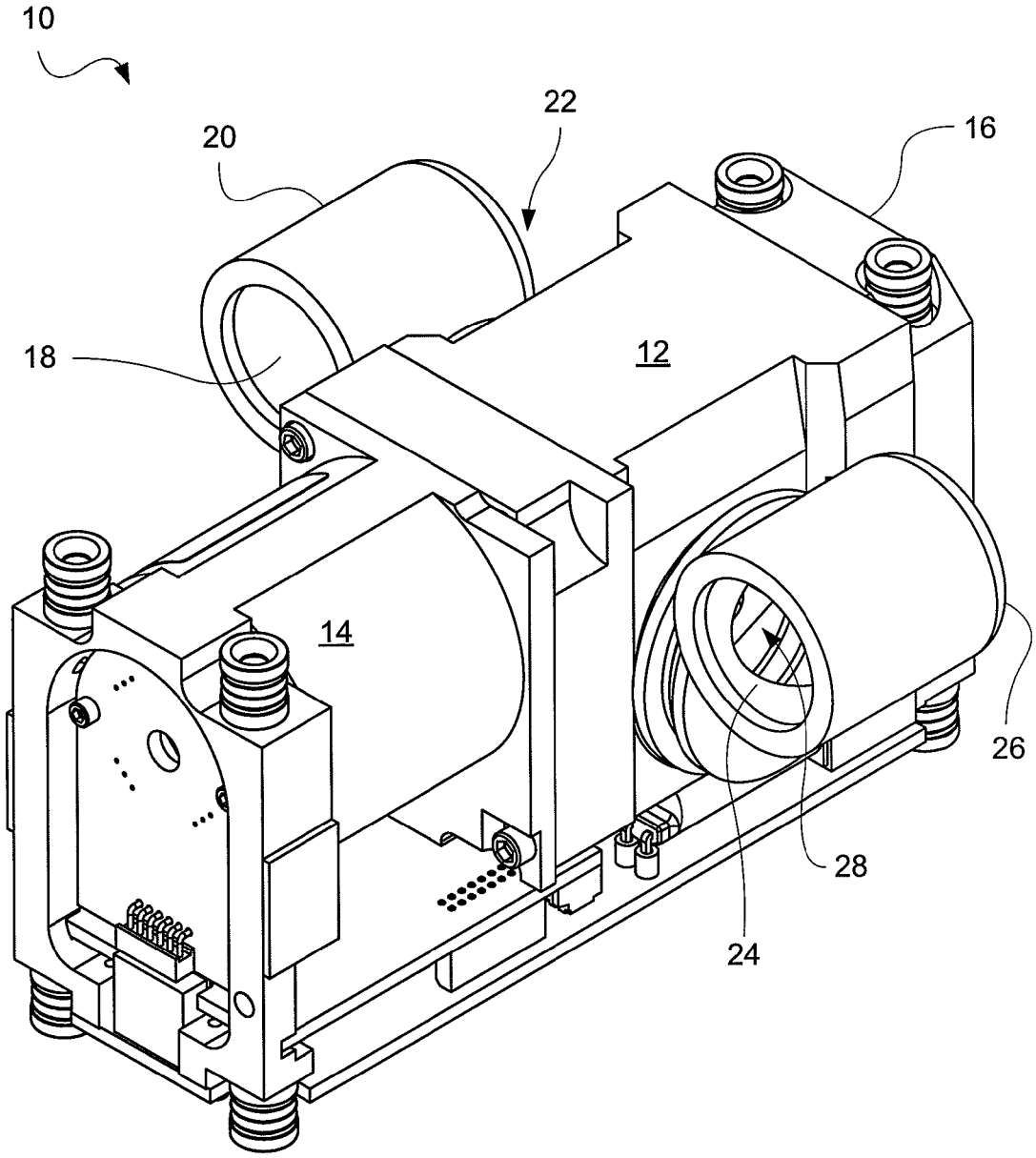
FIG. 1 is a perspective view of a complete Roots-type blower.

The invention will now be described with reference to the drawing figures, in which like reference numerals refer to like parts throughout. Some embodiments in accordance with the present invention provide an improved Roots-type blower wherein production of noise artifacts related to leakback variation with rotor angular position is reduced in comparison to previous Roots-type blowers.

Rotors described in the discussion that follows, whether helical or straight-cut, are cycloidal rather than involute in section. This omits a tendency to instantaneously trap and compress fluid volumes, and thus eliminates an additional well-understood noise source.

Two distinct phenomena characterize helical rotors as compared to straight rotors used as blowers for air as in the invention disclosed herein, namely output rate and leakback rate. Helical rotors can be configured to provide substantially constant output rate over a cycle of rotation, particularly when compared to the pulsating output rate characteristic of straight rotors. However, leakback may be rendered more variable in the otherwise-desirable helical rotors than in straight rotors by a particular dimension of helical rotors.

FIG. 1 is a perspective view of an example of a Roots-type blower 10, wherein a housing 12 is bounded on a first end by a motor cover 14, and on a second end by a gear cover 16. An inlet 18 is established by the housing 12 shape and by an inlet port cover 20, with the latter concealing the inlet port 22 in this view. An outlet 24 is likewise established by the housing 12 shape and by an outlet port cover 26, concealing the outlet port 28.

Figure 2:
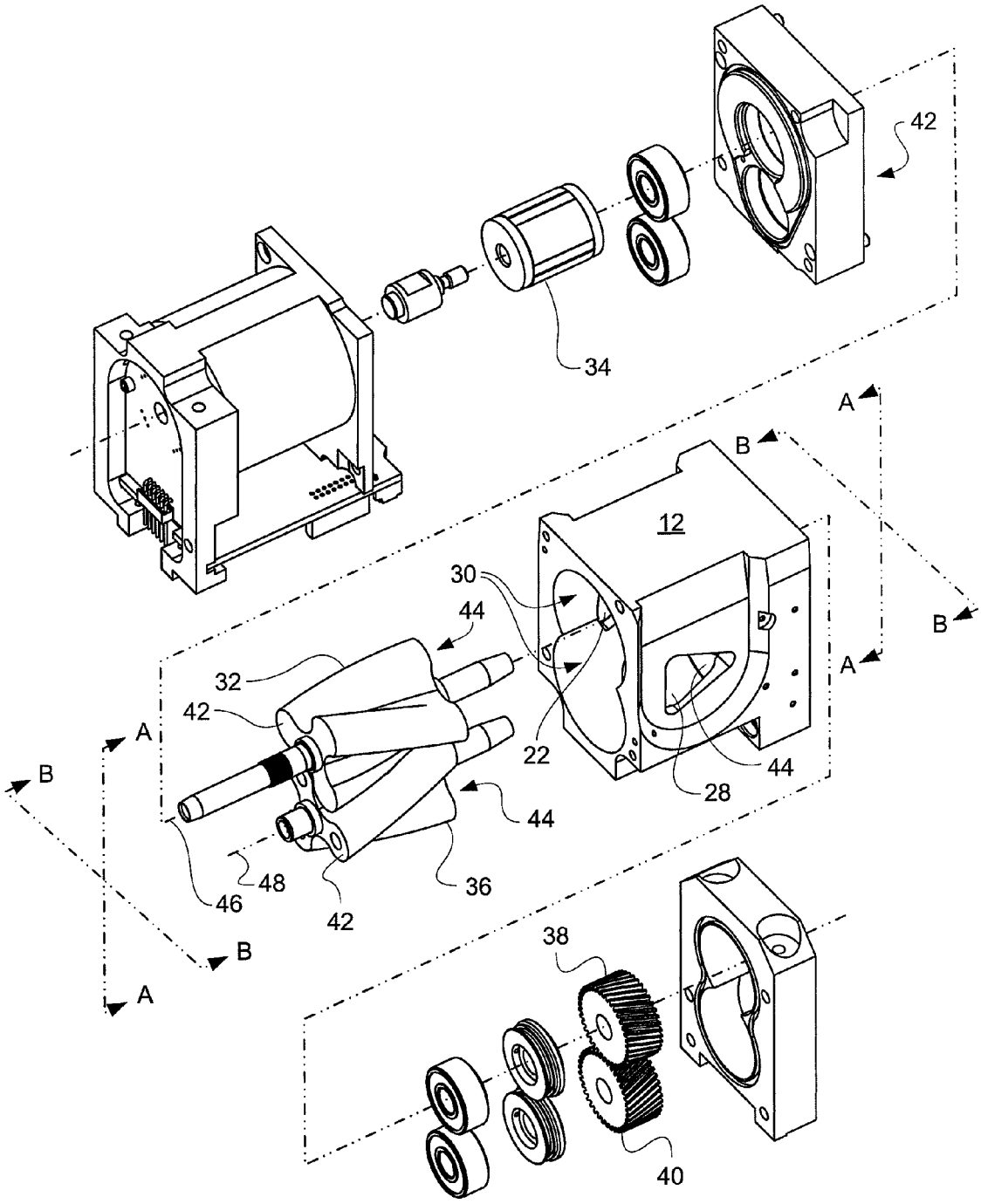
FIG. 2 shows the blower of FIG. 1 in exploded form.

FIG. 2 is an exploded perspective view of the blower of FIG. 1, less the inlet and outlet port covers. The housing 12 includes a twinned chamber 30. In this view, the driving rotor 32 (connected to the motor 34) and the driven (idler) rotor 36 may be seen to form mirror-image helices, configured to counter-rotate with a constant gap between proximal surfaces along a continuous line, as addressed in detail below. Driving and driven (idler) gears 38 and 40, respectively, are adjustably coupled to the respective rotors 32 and 36. The inlet port 22 and outlet port 28 may be seen in this view. Details of fastenings and bearings are not affected by the invention, and are not further addressed herein. Section plane A-A-A-A includes the rotor axes 46, 48, coinciding with the bore axes of the twinned chamber 30.

The discussion below addresses the rotor-to-chamber interface and the interface between respective rotors in view of leakback. Aspects of blower design that attenuate leakback-induced noise are addressed in that context.

The interface between the helical rotors 32, 36 and the chamber 30 in which they operate has substantially flat first (motor)-end 42 and second (gear)-end 44 boundaries of largely constant leakback flow resistance, and, prior to the present invention, perimeter wall boundaries that were likewise largely constant in leakback flow resistance. The interface between two properly formed and spaced and substantially mirror-image helical rotors 32, 36 has a boundary over the length of the rotors that varies periodically with angular position. There is a particular angle exhibiting minimum leakback that recurs at six positions (assuming the two three-lobe rotors of the figures) during each rotation.

Figure 3:
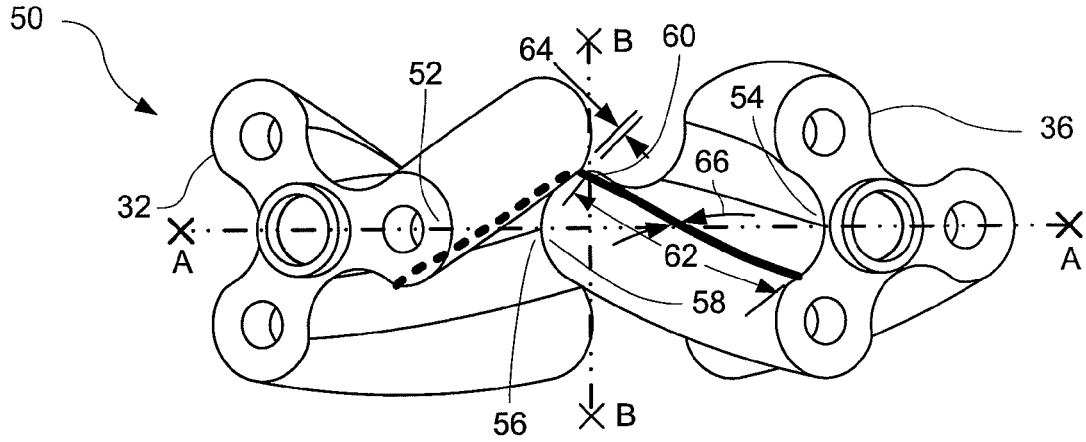
FIGS. 3, 4 and 5 are perspective views that show pairs of rotors, rotated out of alignment for clarity, in zero-, thirty-degree-, and sixty-degree-angle positions, respectively, and including a line on each rotor representing a locus of flow gap between the rotors for each position.

FIG. 3 is a perspective view 50 showing respective rotors 32, 36 tilted away from one another, oriented in a first one of these minimum-leakback angular positions, referred to herein as the zero-angle position. In this position, a first lobe 52 of the first helical rotor 32 is fully engaged with a first interlobe trough 54 of the second helical rotor 36, and first lobe 52 and trough 54 are aligned with plane A-A of the rotor axes 46, 48 (shown in FIG. 2), at the proximal end (closest to the viewer; this may be the gear end, although the shaft is omitted) of the rotors 32, 36. At this zero angle, a second lobe 58, part of the second rotor 36, is fully engaged with a second trough 56, part of the first rotor 32, at the distal end (the motor end if the proximal end is the gear end) of the rotors 32, 36, also in plane A-A. Continuously along the rotor interface, a sinuous gap path 60 having substantially uniform thickness exists. The leakback through this sinuous gap path 60 (when the rotors are parallel as shown in FIG. 2) is likewise substantially uniform, and, as mentioned, at a minimum. The path 60 is shown as a heavy bold line on both rotors 32, 36, dashed where view is blocked by the interposed lobes.

It may be observed that the gap 60 between the rotors 32, 36 at the proximal end, middle, and distal end effectively follows a continuous line that lies approximately in both the plane A-A of the rotor axes and in an interface plane B-B, likewise indicated in FIG. 2, which is a plane perpendicular to the rotor axis plane A-A, and equidistant between the rotor axes 46, 48. As a consequence, there is no predominant direction for leakback flow other than roughly from a centroid of the outlet port 28 to a centroid of the inlet port 22, and thus perpendicular to the plane A-A of the rotor axes and lying in the interface plane B-B. This extent of flow and flow direction are termed natural leakback (NLB) herein. NLB may be quantified as the product of gap width 62 (approximately the rotor length) and gap thickness 64 (inter-rotor spacing, not readily shown with the rotors tilted apart as in this view).

It is to be understood that gap length 66, that is, the travel distance for molecules passing from high to low pressure, is a relatively insignificant factor in flow resistance for mechanical devices, and thus between the rotors 32, 36. Gap cross-sectional area is of greater importance in flow resistance, and thus in leakback in the case of Roots-type blowers.

Figure 4:
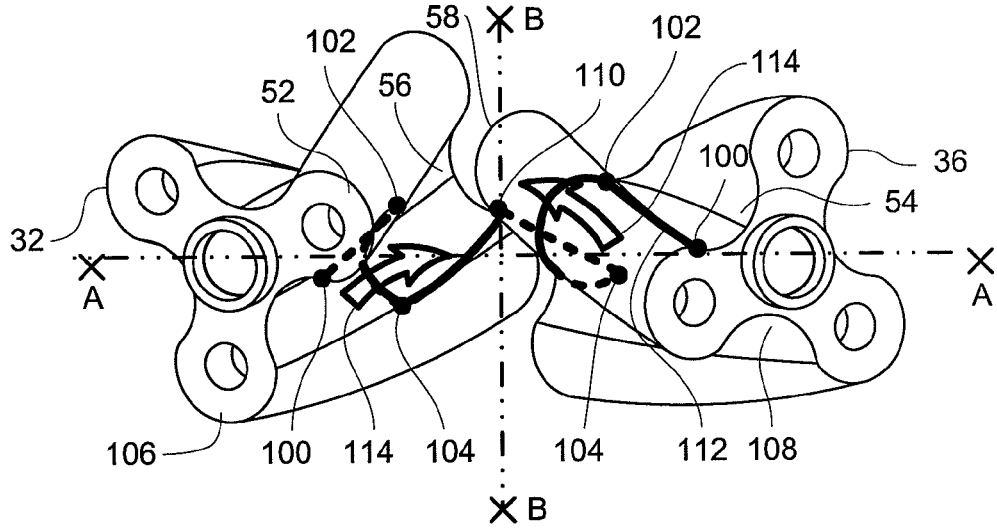

FIG. 4 shows the rotors 32, 36 of FIG. 3, tilted apart for illustrative purposes as before, advanced thirty degrees in rotation. The proximal end of the first lobe 52, previously centered, has advanced, although a transition point 100 on the first lobe 52 is still fully in proximity to a corresponding point 100 on the second rotor 36. At the middle of the rotors 32, 36, corresponding transition points 102, between the first trough 54 and the second lobe 58 and between the first lobe 52 and the second trough 56, are now becoming disengaged, while a second engagement is forming at corresponding transition points 104, between the second trough 56 and the third lobe 106 and between the second lobe 58 and the third trough 108. At the distal end, the second lobe 58 transition to the third trough 108 is at the end of its engagement at corresponding points 110 (overlapping) with the transition between the second trough 56 and the third lobe 106.

In this angular position, a gap path 112 between the rotors 32, 36 has a maximum extent—the gap has an extended shift from 102 to 104, adding about 40% to the width in some embodiments, while the gap thickness remains substantially uniform. Since pressure between the outlet and inlet ports may be constant, this greater width results in lower flow resistance. This lower flow resistance is associated with maximum leakback. It is to be observed that, while the path 112 at the thirty degree rotational position remains roughly in the interface plane B-B, it is distended out of the plane of the rotor axes 68 in greater part than the gap path 60 shown in FIG. 3. As a consequence, the direction of leakback flow has at least a component 114 that is axial, that is, perpendicular to the outlet-to-inlet port direction, in a proximal-to-distal direction.

Figure 5:
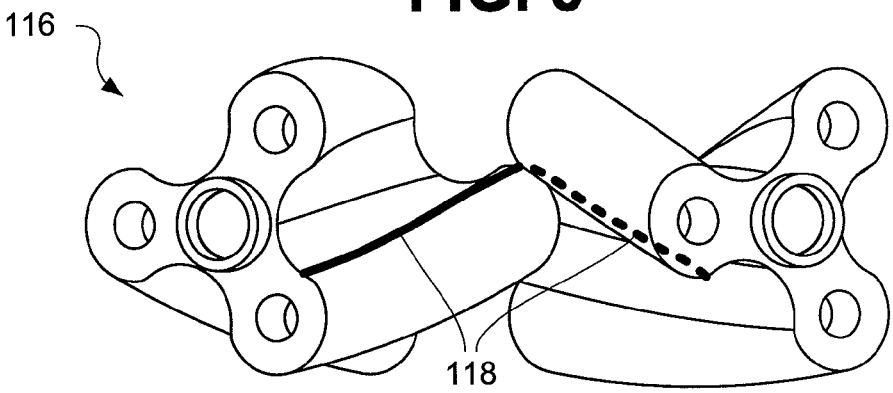

As the rotors continue to advance, the sixty degree position 116, shown in FIG. 5, mirrors the zero degree position of FIG. 3, with leakback through a sinuous gap path 118 again at a minimum. The ninety degree position, not shown, mirrors the thirty degree position of FIG. 4. In the ninety degree position, the angle between the sinuous gap path and the rotor axis plane is reversed, so that the axial component of flow is reversed from that of the axial component of flow 114 of the thirty degree position, to a distal-to-proximal direction.

Figure 6:
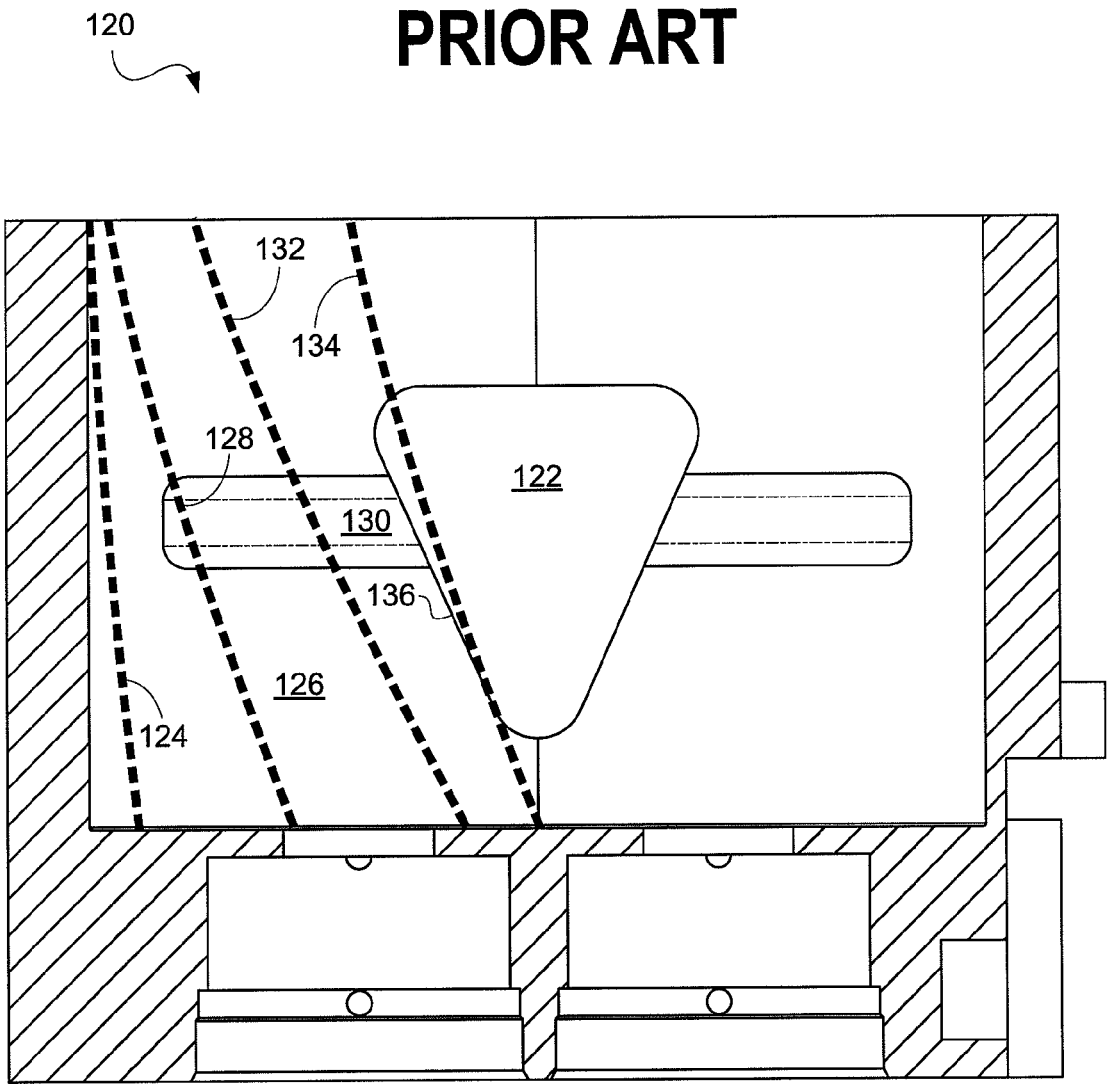
FIG. 6 PRIOR ART
FIG. 6 shows a section view of the housing component of a blower according to the prior art.

FIG. 6 is a section view 120, looking toward the outlet port 122, of a prior-art chamber. Dashed lines represent a lobe tip at representative positions. A first dashed line 124 represents a lobe tip still end-to-end proximal to—and providing a baseline extent of leakback with respect to—the chamber wall 126. In this position, the lobe tip serves as the leading edge of a gulp that holds an air volume not yet directly in contact with fully pressurized air at the outlet port 122.

A second line 128 represents the same lobe tip, advanced sufficiently to begin opening a relief groove 130, let into the chamber with gradually increasing depth of penetration of the chamber wall, and ultimately cutting into the outlet port 122 sidewall (the perimeter surface perpendicular to the rotor axis plane A-A), whereby air pressure present at the outlet port 122 begins to be introduced into the gulp. A third line 132 represents the same lobe tip, advanced sufficiently to open the gulp directly to the outlet port 122. When the lobe tip has advanced to the position of a fourth line 134, the gulp is fully open to the outlet port 122. Because the leading edge 136 of the outlet port 122 is set to approximate the angle of the lobe tip, the opening of the outlet port 122 to the gulp is abrupt, mediated by the relief groove 130. The effect of the configuration of FIG. 6 defines the reference pressure pattern of FIG. 9, discussed below. In particular, although relief grooves 130, 152 from the outlet port 122, 142, as described herein and illustrated in FIGS. 6 and 7, may compensate in greater or lesser part for variations in leakback, no relief groove arrangement alone has been shown to be strongly effective in suppressing emitted noise due to leakback-connected pressure fluctuation over rotor angular position. This observation applies to substantially any configuration of relief grooves, whereof those shown in FIGS. 6 and 7 are representative.

Figure 7:
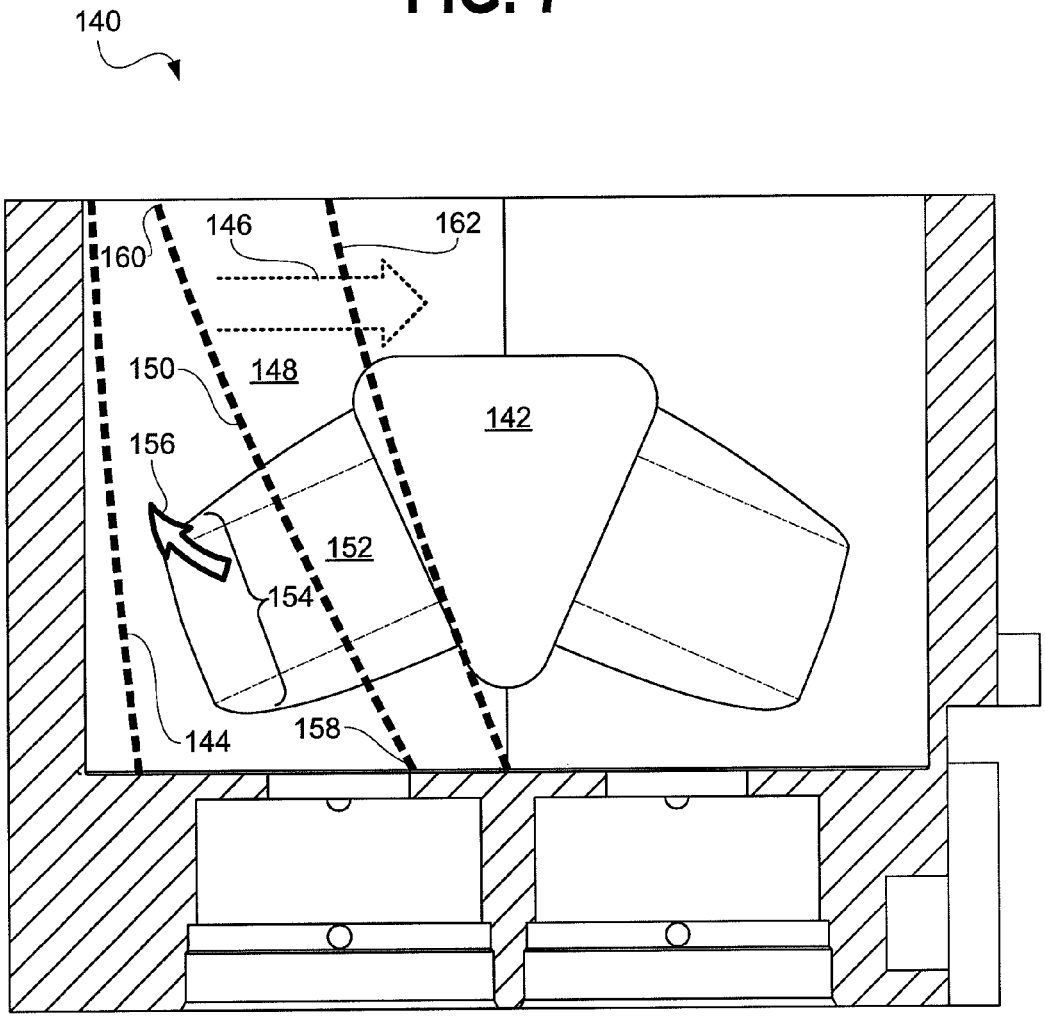
FIG. 7 shows a corresponding section view of the housing component of a blower according to the present invention.

FIG. 7 shows a section view 140 of a chamber incorporating an embodiment of the invention. The view is outward toward the outlet port 142, with dashed lines representing lobe tips at illustrative positions during regular (i.e., transport from inlet to outlet) rotor motion 146. A first line 144 represents a lobe tip still fully proximal to the chamber wall 148, while a second line 150 represents the same lobe tip, advanced sufficiently to begin opening a relief groove 152, whereby the outlet port 142 air pressure begins to be introduced into the gulp. A third line 162 represents the same lobe tip, having advanced sufficiently to begin opening the gulp to the outlet port 142 itself.

Figure 8:
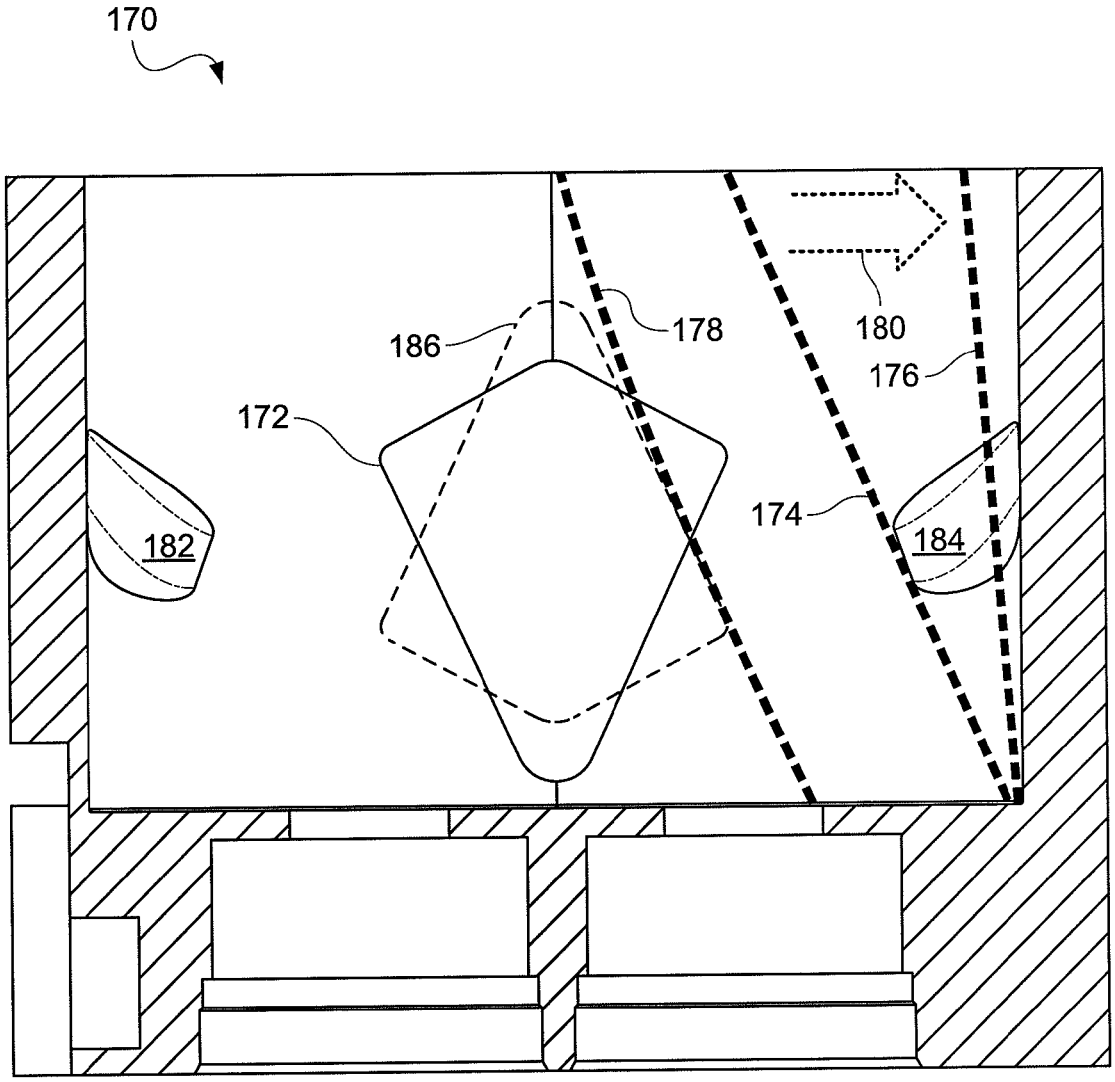
FIG. 8 shows the opposite section of the housing of FIG. 7 according to the present invention.

FIG. 8 is a section view 170 of a chamber according to the invention, looking instead toward the inlet port 172. Dashed lines 174, 176, and 178 represent lobe tip positions during regular motion 180. Relief recesses 182, 184 provide auxiliary leakback paths that depend on rotor angular position for the extent of auxiliary leakback provided. Lobe tip position 174 provides no auxiliary leakback path. This corresponds to the thirty degree angle position of FIG. 6, wherein natural leakback between rotors 32, 36 includes axial flow path 114 and is maximized.

Lobe tip position 176, in contrast, provides a maximized auxiliary leakback path. This corresponds to the zero rotor angle position of FIG. 3, wherein natural leakback between rotors 32, 36 is minimized, and to lobe tip position 150 of FIG. 7, wherein relief groove 152 provides appreciable coupling into the same otherwise-closed gulp. The combination of coupling into the gulp as shown in FIG. 7 and coupling out of the gulp as shown in FIG. 8 provides leakback than can be calibrated by adjusting shape, size, and position of relief recesses 182, 184 to offset variations in natural leakback to an arbitrarily precise extent.

The phenomena repeat at six rotation angles, alternating between the rotors, for a blower having two three-lobed helical rotors. Intermediate angles realize intermediate and alternating exposure of relief recesses 182, 184, so that leakback may be adjusted to remain substantially constant with angle. Natural leakback flow may be seen to be largely directed from outlet to inlet, and thus non-axial, at minimum flow, for which the relief recesses 182, 184 provide an auxiliary path, and to have a significant axial component 114, shown in FIG. 6, at maximum extents of natural leakback flow.

Design detail of the relief recesses 182, 184 is optional. In the embodiment illustrated in FIG. 8, an arcuate path substantially at right angles to the helical lobe tip line is defined with maximum width and depth generally aligned with the rotor angle of minimum natural leakback, and with depth and width going to zero—i.e., no penetration of the chamber wall—at angles of maximum natural leakback. Axial location of the relief recesses 182, 184 is generally centered in the respective walls of the chamber in the embodiment shown. Verification of specific configurations is necessarily experimental, emphasizing both air pressure range and acoustic measurements, as a plurality of factors, such as edge shapes, surface finishes, cavity resonances, and the like, may contribute noise to a specific configuration despite general conformance to the indicated arrangement.

It is to be noted that a representative prior-art blower, such as that whereof the outlet side is shown above in FIG. 6, may employ substantially the same inlet arrangement as that shown in FIG. 8, except without relief recesses 182, 184, and with the profile of the input port 172 inverted, as represented by dashed port 186. This inverted input port 186 profile can cause a more abrupt closing of the port 186 by the lobe tip transitioning past edge position 178.

Figure 9:
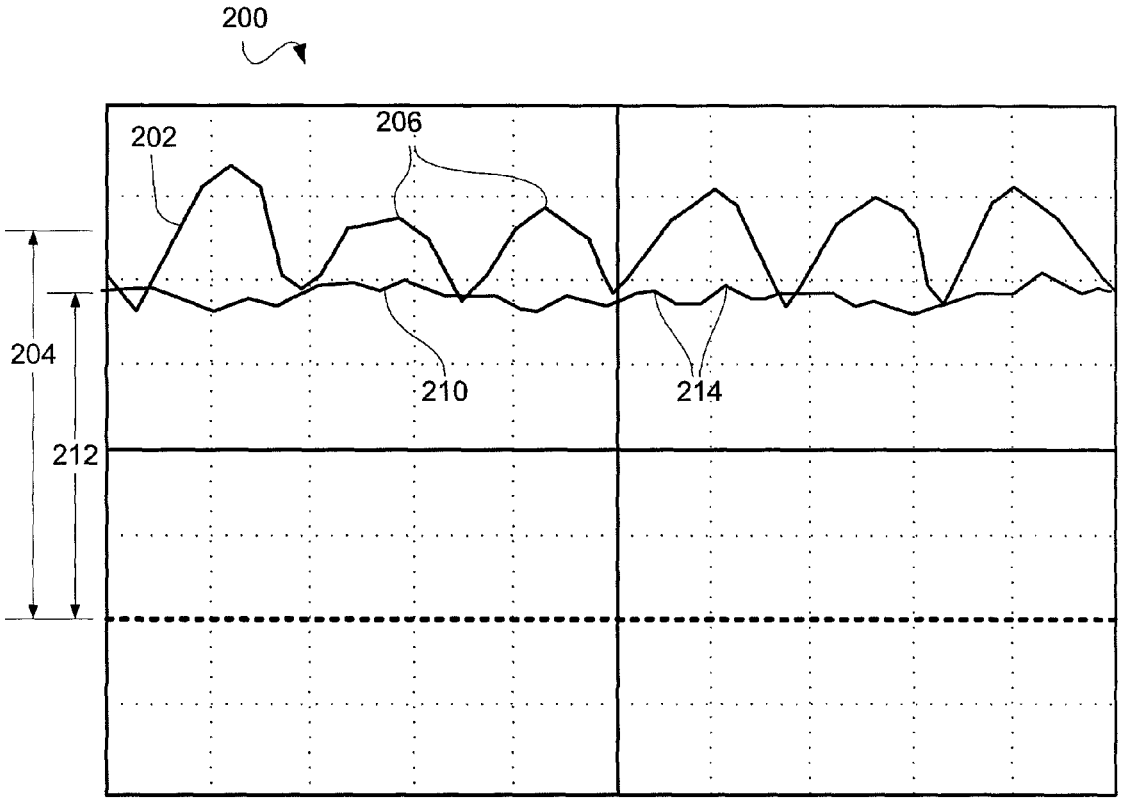
FIG. 9 plots leakback variation over 1 revolution for substantially identical blowers, one of which is made according to prior art, and the other of which is substantially identical to prior art, but also incorporates the features of the instant invention.

FIG. 9 is a plot 200 of leakback flow as a function of angle for prior and inventive designs, showing that the above-described variation in gap width and thus in flow resistance produces measurable variation in leakback, and consequently a measurable noise artifact directly associated with rotation speed and outlet pressure. Variable leakback for a prior design manifests in a first graph of leakback flow 202. This is non-constant 204 over angular position, and exhibits a noticeable peak 206 six times per shaft revolution.

FIG. 9 further shows a second graph 210 of output pressure as a function of angular position, realized by incorporating the inventive improvement into an otherwise substantially identical blower. In the improved blower, the nominal leakback flow 212 is comparable to that 204 of the baseline blower, but the magnitude of pressure peaks 214 associated with the minimum leakback angular positions of FIGS. 3 and 5 is appreciably lower. The sources of this improvement include providing relief recesses 182, 184, such as those in the embodiment shown in FIG. 8, along with secondary improvements introduced through inverting the input port from 186 to 172 and modifying the relief grooves from 130 to 152, as shown in FIGS. 6 and 7.

The existence of an absolute gap between the rotors, and of gaps between each rotor and the cylindrical wall of the chamber, is preferred under all operational conditions in order for power consumption, noise, and wear to be kept low. To assure this, materials for the rotors and chamber, at least, may either be the same or display comparable temperature coefficients of expansion ($C_T$), so that gaps between parts are substantially invariant over temperature. For example, in an embodiment for which a particular aluminum alloy is preferred for a blower 10, as shown in FIG. 1, it may be preferable that all parts of the enclosure, including housing 12, end plates 14, 16, and the like, be fabricated from this alloy and subjected to the same heat treatment if such treatment affects $C_T$. In addition, the rotors, shafts, gears, and associated parts may be fabricated either from the same alloy or from another material having a substantially equal—and isotropic—$C_T$. Poly ether ether ketone (PEEK), to cite one of several engineering plastics that may be suited to rotor applications, may be filled with materials that jointly realize a product with a $C_T$ that closely conforms to that of certain aluminum alloys, and may thus be suited to inclusion in a low-noise blower according to the invention.

A relief recess construct may be derived that is consistent with a specific embodiment, substantially similar to that shown in FIG. 8, wherein a blower has three-lobe cycloidal rotors with sixty degree helical advance. The rotors operate within a chamber having a wall as described above. Relief recesses compatible with this blower lie within cylindrical reference volumes. Each reference volume has an axis of rotation lying in a reference plane defined approximately by the slope (line) of the helix of a rotor lobe tip at a mid-chamber plane perpendicular to the rotor axis, and by the intersection (point) of the mid-chamber plane with the proximal rotor axis. The axis of rotation of the reference volume is parallel to the helix slope at a point of intersection between the reference plane and the chamber wall. The reference volume radius exceeds the rotor lobe radius. The reference volume intersects the chamber wall along a continuous path further limited in extent by the rotor axis plane and a limit plane parallel to the interface plane and including the proximal rotor axis. The relief recess may have radiused surfaces rather than occupying the entire reference volume.

The ability of a relief recess to augment natural leakback is achieved by providing a bypass path. A lobe in motion over the relief recess may provide maximum bypass area when centered over the relief recess if the geometry of the relief recess includes at least a principal radius (the radius of the reference volume described above) greater than the radius of the lobe at its addendum extent (maximum rotor radius), as shown in FIG. 3, for example.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A Roots-type blower exhibiting reduced noise, comprising:

a pair of rotors, configured to counter-rotate about parallel axes in an axis plane, wherein the respective rotors each comprise a plurality of cycloidal-profile lobes having tips that are located at the maximum radial extent thereof, and advancing with axial position as opposite-handed helices, and wherein rotation of the tips of the respective rotor lobes defines a negative body in the form of a pair of overlapping cylindrical sections truncated at axial extents of the rotors;

a blower housing with walls that define a chamber to enclose the rotor pair, wherein the negative body establishes a physical extent of the chamber, and wherein the chamber wall is further positioned away from the negative body by a substantially uniform clearance distance;

an inlet port penetrating the chamber wall, wherein an inlet port perimeter wall is symmetric about an interface plane substantially equidistant between the rotor axes;

an outlet port penetrating the chamber wall, wherein an outlet port perimeter wall is symmetric about the interface plane at a location substantially opposed to that of the inlet port; and a pair of relief recesses in the chamber wall, positioned and shaped with substantial bilateral symmetry to one another with reference to the interface plane, wherein the relief recesses are bounded on their respective perimeters by continuous cylindrically curved portions of the chamber wall.

2. The Roots-type blower of claim 1, further comprising:

a pair of relief grooves, let into the chamber wall and extending continuously into the outlet port, wherein the respective relief grooves are dimensionally specified at successive angular positions by width and depth of the relief grooves at radial projections of lobe tips from the respective rotor lobes.

3. The Roots-type blower of claim 2, wherein groove area is zero at angular positions of rotor lobes more distal from the outlet port than a first selected position, wherein groove width, depth, and position on the cylinder wall vary according to a selected arrangement, and wherein groove cross-sectional area is nondecreasing with advancing angular positions of rotor lobes toward the outlet port referred to rotation of the rotors in a direction to cause inlet-to-outlet flow.

4. The Roots-type blower of claim 1, wherein an extent of natural leakback from the outlet port to the inlet port varies periodically with angular position of the rotors, and wherein the relief recesses are oriented to provide a minimum extent of relief recess opening at a rotor angular position corresponding to a maximum extent of natural leakback between the rotors, and a maximum extent of relief recess opening at a rotor angular position corresponding to a minimum extent of natural leakback between the rotors.

5. The Roots-type blower of claim 1, further comprising:

a first three-lobe cycloidal-profile rotor with sixty degree helical advance;

a first relief recess lying within a cylindrical reference volume having an axis of rotation lying in a reference plane defined approximately by the slope line of the helix of a rotor lobe tip at a mid-chamber plane perpendicular to the rotor axes and by the intersection point of the mid-chamber plane with the proximal rotor axis, wherein the axis of rotation of the reference volume is parallel to the helix slope at a point of intersection between the reference plane and the chamber wall, wherein the reference volume curvature is less than the rotor lobe tip curvature, and wherein the reference volume intersects the chamber wall along a continuous path further limited in extent by the rotor axis plane and a limit plane parallel to the interface plane and including the rotor axis proximal to the first relief recess;

a second rotor substantially mirroring the first rotor; and a second relief recess substantially mirroring the first relief recess.

6. The Roots-type blower of claim 1, further comprising rotor and housing materials having substantially equal temperature coefficients of expansion.

7. The Roots-type blower of claim 1, further comprising:

means for drawing fluid into a chamber;

means for urging fluid around two opposed, cylindrical wall surfaces of the chamber in alternate, substantially discrete portions with substantially continuous rate of fluid flow; and means for periodically introducing auxiliary leakback into the means for urging fluid wherein means for periodically introducing auxiliary leakback further comprises two discrete deformations within otherwise substantially uniform wall surfaces, wherein the deformations distend the wall surfaces outward from a reference cylindrical form;

means for determining a first plurality of angular positions of the rotors for which leakback is minimized;

means for determining a second plurality of angular positions of the rotors for which leakback is maximized;

means for identifying a reference lobe distal to the mesh at a first minimized-leakback angular position;

means for providing a recess in the chamber aligned with the reference lobe, wherein the recess routes fluid around a volume enclosure comprising the reference lobe, another lobe on the same rotor, and a first cylindrical cavity of the chamber;

means for limiting the extent of the recess to prevent routing of fluid therethrough at rotor angular positions for which leakback is maximized.

8. The Roots-type blower of claim 7, further comprising:

means for increasing a flow of fluid between the outlet port and a volume enclosed between two adjacent lobes and the wall therebetween.

9. A Roots-type blower exhibiting reduced noise, comprising:

a pair of rotors, configured to counter-rotate about parallel axes in an axis plane, wherein the respective rotors each comprise a plurality of cycloidal-profile lobes having tips that are located at the maximum radial extent thereof, and advancing with axial position as opposite-handed helices, and wherein rotation of the tips of the respective rotor lobes defines a negative body in the form of a pair of overlapping cylindrical sections truncated at axial extents of the rotors;

a blower housing with walls that define a chamber to enclose the rotor pair, wherein the negative body establishes a physical extent of the chamber, and wherein the chamber wall is further positioned away from the negative body by a substantially uniform clearance distance;

an inlet port penetrating the chamber wall, wherein an inlet port perimeter wall is symmetric about an interface plane substantially equidistant between the rotor axes;

an outlet port penetrating the chamber wall, wherein an outlet port perimeter wall is symmetric about the interface plane at a location substantially opposed to that of the inlet port;

a pair of relief recesses in the chamber wall, positioned and shaped with substantial bilateral symmetry to one another with reference to the interface plane, wherein the relief recesses are bounded on their respective perimeters by continuous cylindrically curved portions of the chamber wall;

a pair of shafts whereto the respective rotors are fixed; and a set of bearings configured to maintain substantially constant longitudinal and radial position of the respective shafts during blower operation over a selected range of angular rates, accelerations, and pressure loads.

10. The Roots-type blower of claim 9, having three-lobe rotors with sixty degree helical advance, wherein:

a first relief recess has maximum leakback area at a zero rotor reference angle, wherein a first-rotor angular position comprises a first lobe tip whereof a gear-end extent lies in the rotor axis plane, proximal to a gear-end extent of a first interlobe trough, located on the second rotor; and a second-rotor angular position comprises a second lobe tip whereof a motor-end extent lies in the rotor axis plane, proximal to a motor-end extent of a second interlobe trough, located on the first rotor;

the first relief recess is substantially continuously concave; and a first-rotor lobe, radially opposite at its gear end extent maximum to the motor-end extent maximum of the first lobe, and advancing helically from the intersection of the chamber with the plane of the rotor axes toward the inlet port, crosses the plane of maximum leakback depth of the first relief recess.

11. The Roots-type blower of claim 10, wherein:

a first relief recess has minimum leakback area at a thirty degree angle, wherein a first rotor angular position is rotated thirty degrees from the zero angle, wherein a first lobe tip gear-end extent is rotated thirty degrees of shaft angle out of the rotor axis plane; and a second rotor angular position is rotated thirty degrees from the zero angle, wherein a second lobe tip motor-end extent is rotated thirty degrees of shaft angle out of the rotor axis plane.

12. The Roots-type blower of claim 9, further comprising:

a meshed gear pair, configured to regulate counter-rotation of the rotor pair at a substantially constant relative rate over a selected range of angular rates, accelerations, and pressure loads, wherein the respective gears are attached to respective rotor shafts proximal to adjacent ends thereof; and a motor, coupled to a first one of the rotor shafts, located distal to the gear attached to the first shaft, configured to apply rotational force to the first rotor shaft in response to application of power to the motor.

* * * * *